US007593847B2

(12) United States Patent
Oh

(10) Patent No.: US 7,593,847 B2
(45) Date of Patent: Sep. 22, 2009

(54) PITCH DETECTION METHOD AND APPARATUS

(75) Inventor: Kwangcheol Oh, Gyeonggi-do (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 860 days.

(21) Appl. No.: 10/968,942

(22) Filed: Oct. 21, 2004

(65) Prior Publication Data

US 2005/0091045 A1 Apr. 28, 2005

(30) Foreign Application Priority Data

Oct. 25, 2003 (KR) ..... 10-2003-0074923

(51) Int. Cl.
*G10L 11/04* (2006.01)
*G10L 19/00* (2006.01)

(52) U.S. Cl. ..... 704/207; 704/218; 704/219

(58) Field of Classification Search ..... None
See application file for complete search history.

(56) References Cited

U.S. PATENT DOCUMENTS

| | | | | |
|---|---|---|---|---|
| 5,809,453 | A * | 9/1998 | Hunt | 704/214 |
| 5,867,816 | A * | 2/1999 | Nussbaum | 704/232 |
| 6,226,606 | B1 * | 5/2001 | Acero et al. | 704/218 |
| 6,917,912 | B2 * | 7/2005 | Chang et al. | 704/207 |
| 2004/0102965 | A1 * | 5/2004 | Rapoport | 704/207 |
| 2004/0193407 | A1 * | 9/2004 | Ramabadran et al. | 704/207 |

FOREIGN PATENT DOCUMENTS

EP 637012 A2 * 2/1995

OTHER PUBLICATIONS

"Enhanced Pitch Tracking and the Processing of F0 Contours for Computer Aided Intonation Teaching," by Bagshaw et al., Proceedings of the European Conference on Speech Communication and Technology, vol. 2, pp. 1003-1006, Sep. 1993.

"Super Resolution Pitch Determination of Speech Signals," by Medan et al., IEEE Transactions on Signal Processing, vol. 39, No. 1., pp. 40-48, Jan. 1991.

"Super Resolution Pitch Determination of Speech Signals," by Yoav Medan et al., pp. 40-48, IEEE Trans Signal Processing, vol. 39, No. 1, pp. 40-48; Jan. 1991.

"Enhanced Pitch Tracking And the Processing of F0 Contours For Computer Aided Intonation Teaching," by P.C. Bagshaw, et al., Proc. Of 3rd European Conference on Speech Communication and Technology, vol. 2, pp. 1003-1006, Berlin, 1993.

* cited by examiner

*Primary Examiner*—Matthew J Sked
(74) *Attorney, Agent, or Firm*—Staas & Halsey LLP

(57) ABSTRACT

A pitch detection method and apparatus, the pitch detection apparatus includes: a data rearrangement unit which rearranges voice data on the basis of a center peak of the voice data included in a single frame; a decomposition unit which decomposes rearranged voice data into even symmetrical components on the basis of a center peak; a pitch determination unit which obtains a segment correlation value between a reference point and at least one or more local peaks in relation to even symmetrical components, and determines the location of a local peak corresponding to a maximum segment correlation value among the obtained segment correlation values, as a pitch period.

24 Claims, 3 Drawing Sheets

PITCH DETECTION METHOD AND APPARATUS

CROSS-REFERENCE TO RELATED APPLICATIONS

This application claims the benefit of Korean Patent Application No. 2003-74923, filed on Oct. 25, 2003 in the Korean Intellectual Property Office, the disclosure of which is incorporated herein in its entirety by reference.

BACKGROUND OF THE INVENTION

1. Field of the Invention

The present invention relates to pitch detection, and more particularly, to a method and apparatus for detecting a pitch by decomposing voice data into even symmetrical components and then obtaining segment correlation values.

2. Description of the Related Art

In the voice signal processing field such as voice recognition, synthesis and analysis, it is important to accurately detect a fundamental frequency, that is, a pitch period. If the fundamental frequency of a voice signal can be accurately detected, effects caused by a speaker's voice in voice recognition can be reduced such that the accuracy of the recognition can be raised, and when the voice is synthesized, naturalness and individual characteristics can be easily modified or maintained. In addition, in voice analysis, if the voice is analyzed in synchronization with a pitch, accurate vocal tract parameters in which the effect of a glottis is removed can be obtained.

Thus, performing pitch detection in a voice signal is an important part and methods for pitch detection have been suggested in a variety of ways. These methods can be broken down into time domain detection, frequency domain detection, and time-frequency hybrid domain detection.

Time domain detection is a method emphasizing periodicity of waveforms and then detecting a pitch by a decision logic, and includes a parallel processing method, average magnitude difference function (hereinafter referred to as AMDF), and auto-correlation method (hereinafter referred to as ACM). These methods are usually performed in time domain such that transforming of the domain is not needed and only simple operations such as addition, subtraction, and comparison logics are needed. However, when a phoneme stretches over a transition interval, signal power levels in a frame change severely and the pitch period changes. Accordingly, detection of a pitch is difficult and influenced by a formant in that interval. In particular, when voice is mixed with noise, decision logic for pitch detection is complicated such that detection error increases. More specifically, in the ACM method, it is highly probable that pitch determination errors, including mistaking a first formant for a pitch, pitch doubling, and pitch halving, occur.

Frequency domain detection is a method detecting the fundamental frequency of voiced sound by measuring harmonic intervals of a voice spectrum, and a harmonic analysis method, Lifter method, and Comb-filtering method have been suggested as frequency domain detection. Since a spectrum is generally obtained within a frame with a duration of 20 to 40 ms, even if phoneme transition/change or background noise occurs within the frame, the influence is not great. However, the detection processing needs to transform to a frequency domain and therefore, the calculation is complicated. If the number of FFT pointers is increased in order to raise the accuracy of a fundamental frequency, the processing time increases proportionately and it is difficult to accurately detect the changed characteristic.

Time-frequency hybrid domain detection is based on the advantages of the two methods, calculation time reduction and pitch accuracy of the time domain detection and frequency domain detection's capability of accurately obtaining a pitch despite background noise or phoneme change. This includes the Cepstrum method, and the spectrum comparison method. However, in these methods, when time domain and frequency domain are alternately visited, errors increase and can affect pitch detection accuracy. In addition, since the time and frequency domains are applied at the same time, the calculation is complicated.

SUMMARY OF THE INVENTION

According to an aspect of the present invention there is provided a pitch detection method and apparatus by which voice data contained in a single frame is decomposed into even symmetrical components and a maximum segment correlation value between a reference point and each of local peaks is determined as a pitch period.

According to another aspect of the present invention, there is provided a pitch detection apparatus including: a data rearrangement unit which rearranges voice data based on a center peak of the voice data included in a single frame; a decomposition unit which decomposes the rearranged voice data into even symmetrical components based on the center peak; a pitch determination unit which obtains a segment correlation value between a reference point and at least one or more local peaks in relation to the even symmetrical components, and determines the location of a local peak corresponding to a maximum segment correlation value among the obtained segment correlation values, as a pitch period.

According to another aspect of the present invention, there is provided a pitch detection method including: decomposing voice data into even symmetrical components based on a center peak of the voice data included in a single frame; obtaining a segment correlation value between a reference point and at least one or more local peaks in relation to the even number symmetrical components; and determining the location of a local peak corresponding to a maximum segment correlation value among the obtained segment correlation values, as a pitch period.

According to another aspect of the present invention, the method can be implemented by a computer readable recording medium having embodied thereon a computer program for executing the method in a computer.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1:
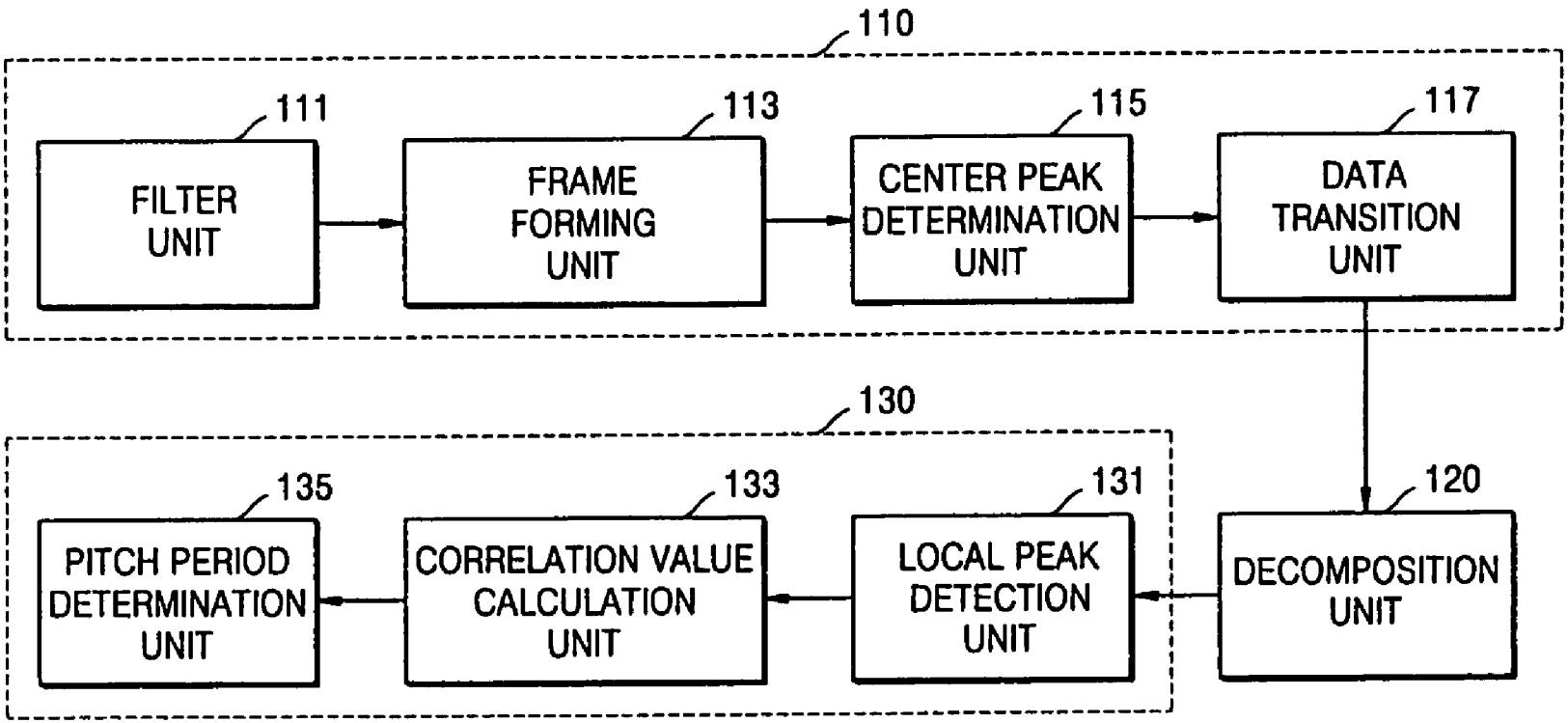
FIG. 1 is a block diagram of the structure of an embodiment of a pitch detection apparatus according to an aspect of the present invention.

Reference will now be made in detail to the embodiments of the present invention, examples of which are illustrated in the accompanying drawings, wherein like reference numerals refer to the like elements throughout. The embodiments are described below to explain the present invention by referring to the figures.

FIG. 1 is a block diagram of the structure of an embodiment of a pitch detection apparatus according to an aspect of the present invention. The pitch detection apparatus includes a data rearrangement unit 110, a decomposition unit 120, and a pitch determination unit 130. The data rearrangement unit 110 includes a filter unit 111, a frame forming unit 113, a center peak detection unit 115, and a data transition unit 117. The pitch determination unit 130 includes a local peak detection unit 131, a correlation value calculation unit 133, and a pitch period determination unit 135. Operation of the pitch detection apparatus shown in FIG. 1 will now be explained in relation to the waveforms shown in FIGS. 2A to 2C.

Referring to FIG. 1, in the data rearrangement unit 110, the filter unit 111 is implemented by an infinite impulse response (IIR) or finite impulse response (FIR) digital filter, and is a low pass filter, for example, with a cutoff frequency having a frequency characteristic of 230 Hz. The filter unit 111 performs low pass filtering of voice data, which is analog-digital data, to remove high frequency components, and finally outputs voice data with a waveform as shown in FIG. 2A.

The frame forming unit 113 divides voice data provided by the filter unit 111, in predetermined time units, and forms frame units. For example, when analog-to-digital conversion is performed and the sampling rate is 20 kHz, if 40 msec is set as a predetermined time unit, a total of 800 samples form one frame. Since a pitch is usually between 50 Hz and 400 Hz, the number of samples required to detect a pitch, that is, a unit time, is set to twice 50. Hz, that is, 25 Hz or 40 msec. At this time, preferably, but not required, the interval between adjacent frames is 10 msec. In the above example, when the sampling rate is 20 kHz, the frame forming unit 113 forms a first frame with 800 samples of voice data, and skips over the first 200 samples in the first frame, and then forms a second frame with 800 samples by adding the next 600 samples in the first frame and the next 200 new samples.

Figure 2A:
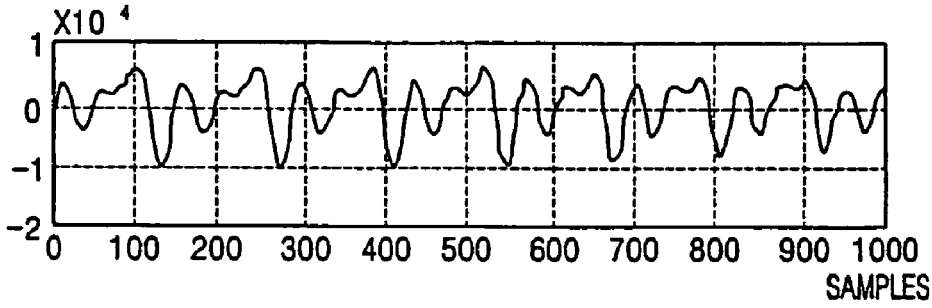
FIGS. 2A through 2C are waveforms of respective modules shown in FIG. 1.

The center peak determination unit 115 multiplies voice data as shown in FIG. 2A, by a predetermined weight window function in time domain, and determines a location where the absolute value of the result of the multiplication is a maximum, as a center peak. Types of weight windows available to use include Triangular, Hanning, Hamming, Blackmann, Welch, and Blackmann-Harris windows.

Figure 2B:
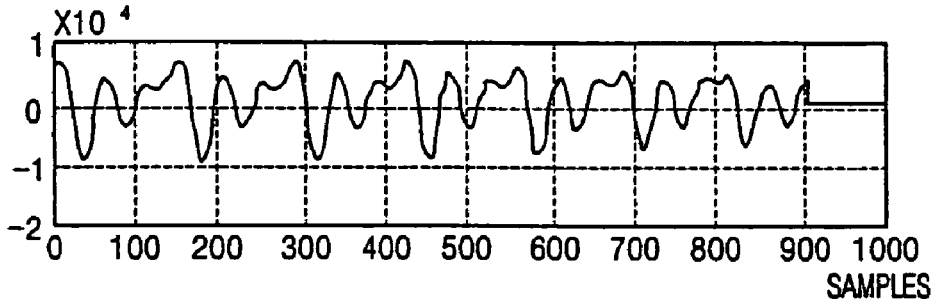

The data transition unit 117 shifts the voice data shown in FIG. 2A on the basis of the center peak determined in the center peak determination unit 115 so that the center peak is placed at the center of the voice data, and outputs a signal with a waveform as shown in FIG. 2B.

Figure 2C:
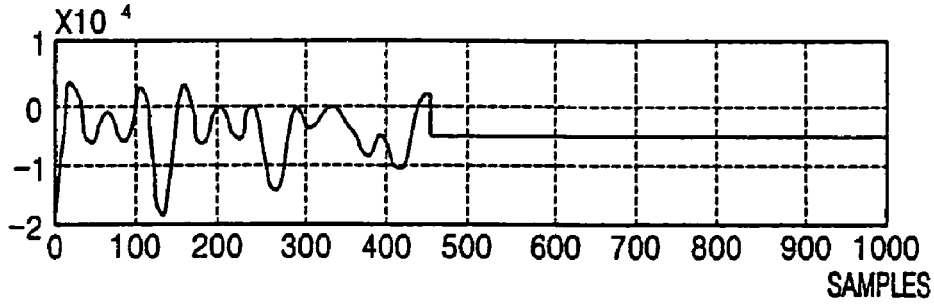

The decomposition unit 120 decomposes the voice data rearranged by the data transition unit 117, into even symmetrical components on the basis of the center peak, and outputs a signal with a waveform as shown in FIG. 2C. This will now be explained in more detail.

First, it is assumed that x(n) is voice data provided by the frame forming unit 113 and rearranged in the data transition unit 117, and is a periodical signal having period $N_0$. That is, for all integer k, $x(n \pm kN_0)=x(n)$. This periodical signal can be decomposed into even and odd symmetrical components, and assuming that s(n) is a symmetrical signal, the following equation 1 is valid:

$$s(n)=s(N-n)=2x_e(n) \tag{1}$$

Here, $x_e(n)$ denotes even symmetrical components, and can be expressed as the following equation 2. Here, N denotes the number of the entire samples of one frame.

$$x_e(n) = \frac{1}{2}[x(n) + x(N-n)],\ n = 1, \ldots, N \tag{2}$$

Signal s(n) generated by equation 1 is symmetrical in relation to period $N_0$ as well as frame length N, and becomes a periodical signal with period $N_0$. That is, like periodical signal x(n), $s(n \pm kN_0)=s(n)$. This can be proved by the following equation 3:

$$\begin{aligned} s(n \pm kN_0) &= x(n \pm kN_0) + x(N - (n \pm kN_0)) \\ &= x(n) + x(N-n) \\ &= s(n) \end{aligned} \tag{3}$$

Meanwhile, in order to more easily explain the symmetry of s(n) in period $N_0$, instead of $s(n)=s(N_0-n)$, $s(N/2+n)=s(N/2+N_0-n)$ will now be proved. That is, it will be proved that s(n) is a symmetrical and periodical signal with respect to the center part of one frame. When each of s(N/2+n) and $s(N/2+N_0-n)$ is explained by x(n), those can be expressed by the following equations 4 and 5:

$$s\left(\frac{N}{2}+n\right) = x\left(\frac{N}{2}+n\right) + x\left(\frac{N}{2}-n\right) \tag{4}$$

$$\begin{aligned} s\left(\frac{N}{2}+N_0-n\right) &= x\left(\frac{N}{2}+N_0-n\right) + x\left(\frac{N}{2}+N_0+n\right) \\ &= x\left(\frac{N}{2}-n\right) + x\left(\frac{N}{2}+n\right) \end{aligned} \tag{5}$$

That is, it can be shown that the right-hand side of the equation 4 is the same as the right-hand side of the equation 5. Accordingly, it can be seen that the even symmetrical components of periodical signal x(n) become a symmetrical and periodical signal within one period.

Meanwhile, in order to prevent the possibility of pitch doubling in which the pitch period detected next is a multiple of a first detected pitch period, the decomposition unit 120 multiplies voice data rearranged in the data transition unit 117 by a predetermined weight window function, and then can decompose the voice data into even symmetrical components on the basis of the center peak. At this time, the weight window function used may be Hamming window or Hanning window. As shown in FIG. 2C, only half of the entire even symmetrical components are used in order to avoid information redundancy in the following process.

In the pitch determination unit 130, the local peak detection unit 131 detects local peaks with a value greater than 0, that is, candidate pitches, from the even number symmetrical components as shown in FIG. 2C provided by the decomposition unit 120. If the actual value of the center peak determined in the center peak determination unit 115 is a negative number, even symmetrical components are multiplied by −1 and then, local peaks with a value greater than 0, that is, candidate pitches, are detected.

The correlation value calculation unit 133 obtains a segment correlation value, ρ(L), between a reference point, that is, sample location '0' and each of local peaks (L) detected by the local peak detection unit 131. At this time, by applying any one of the methods disclosed in an article by Y. Medan, E. Yair, and D. Chazan, "Super resolution pitch determination of speech signals" (IEEE Trans. Signal Processing, ASSP-39 (1), pp 40-48, 1991), and the method disclosed in an article by P. C. Bagshaw, S. M. Hiller, and M. A. Jack, "Enhanced pitch tracking and the processing of F0 contours for computer aided intonation teaching" (pp. 1003-1006, Proc. 3rd. European Conference on Speech Communication and Technology, vol. 2, Berlin), the segment correlation values can be obtained. When the method shown by Y. Medan et al. is used, it can be shown as the following equation 6:

$$x(n) = s(n) \tag{6}$$

$$y(n) = s(L - n - 1)$$

$$(x, y) = \sum_{n=0}^{L/2-1} x(n)y(n), \quad \text{where } 0 \le n \le \frac{L}{2} - 1$$

$$\rho(L) = \frac{(x, y)}{(x, x)(y, y)}$$

Here, L denotes the location of each local peak, that is, a sample location.

The pitch period determination unit 135 selects a maximum segment correlation value among the segment correlation values between a reference point and each local peak calculated in the correlation value calculation unit 133, and if the maximum segment correlation value is greater than a predetermined threshold, determines the location of the local peak used to obtain the maximum segment correlation value, as a pitch period. Meanwhile, if the maximum segment correlation value is greater than the predetermined threshold, it is determined that the corresponding voice signal is voiced sound.

Figure 3:
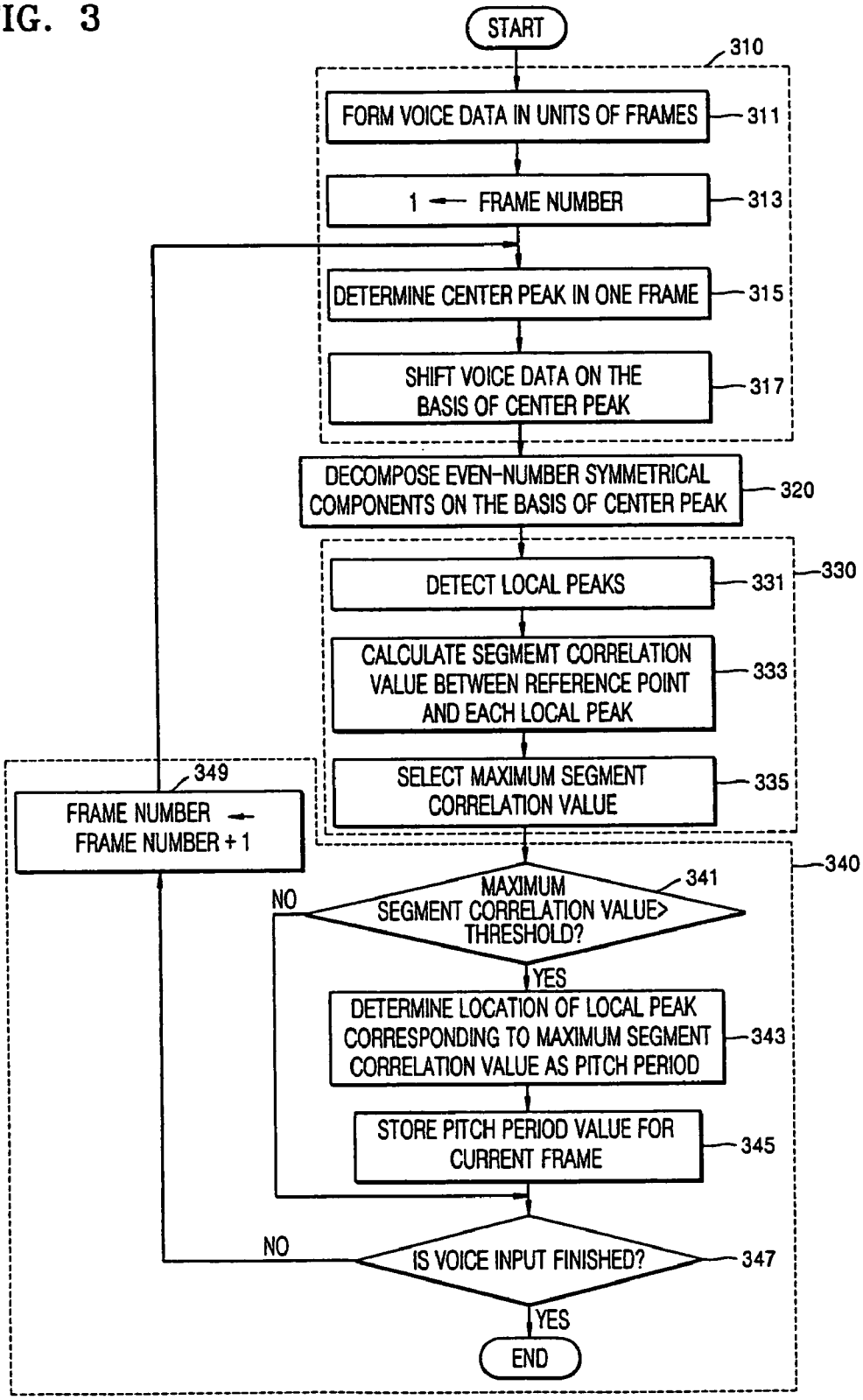
FIG. 3 is a flowchart of operations performed by an embodiment of a pitch detection method according to an aspect of the present invention.

FIG. 3 is a flowchart of operations performed by an embodiment of a pitch detection method according to an aspect of the present invention, and the method includes rearranging voice data 310, decomposition 320, detecting a maximum segment correlation value 330, and pitch period determination 340.

Referring to FIG. 3, in the rearranging voice data 310, voice data being input is formed in units of frames in operation 311. It is preferable, but not necessary, that one frame be about 40 ms that is twice a minimum pitch period. In operation 313, the frame number is set to 1 so that the following operations can be performed for the voice data of the first frame. In operation 315, a center peak in a single frame is determined. For this, voice data in a single frame is multiplied by a predetermined weight window function, and a location where the absolute value of the result of the multiplication is a maximum is determined as a center peak. In operation 317, voice data in a single frame is shifted on the basis of the center peak so that the voice data is rearranged. Though it is not shown, low pass filtering of voice data being input can be performed before operation 311.

In the decomposition 320, the rearranged voice data is decomposed into even symmetrical components on the basis of the center peak in operation 310. As another embodiment, the rearranged voice data can be multiplied by a predetermined weight window function and then decomposed into even symmetrical components on the basis of the center peak in operation 310. In this case, pitch determination errors such as pitch doubling can be reduced greatly.

In the detecting a maximum segment correlation value 330, local peaks are detected from the even symmetrical components decomposed in operation 320, in operation 331. If the value of the center peak is a negative number, the sample locations of local peaks have values less than 0, and if the value of the center peak is a positive number, the sample locations of local peaks have values greater than 0. In operation 333, the segment correlation value between a reference point, that is, sample location 0, and a sample location corresponding to each of local peaks is calculated. In operation 335, a maximum segment correlation value is detected among the segment correlation values of all local peaks.

In the pitch period determination 340, in operation 341, it is determined whether or not the maximum segment correlation value detected in operation 330 is greater than a predetermined threshold, and if the determination result indicates that the maximum segment correlation value is less than or equal to the predetermined threshold, it means that a pitch period is not detected for the corresponding frame, and operation 347 is performed. Meanwhile, if the determination result of operation 341 indicates that the maximum segment correlation value is greater than the predetermined threshold, the location of a local peak corresponding to the maximum segment correlation value, that is, the sample location, is determined as a pitch period in operation 343. In operation 345, the pitch period determined in operation 343 is stored as the pitch period for the current frame. In operation 347, it is determined whether or not voice data input is finished, and if the determination result of operation 347 indicates that voice data input is finished, the method of the flowchart is finished, and if the voice data input is not finished, operation 347 is performed to increase frame number by 1, and then operation 315 is performed so that a pitch period for the next frame is detected.

The invention can also be embodied as computer readable codes on a computer readable recording medium. The computer readable recording medium is any data storage device that can store data which can be thereafter read by a computer system. Examples of the computer readable recording medium include read-only memory (ROM), random-access memory (RAM), CD-ROMs, magnetic tapes, floppy disks, and optical data storage devices. The computer readable recording medium can also be distributed over network coupled computer systems so that the computer readable code is stored and executed in a distributed fashion. Also, functional programs, codes, and code segments for accomplishing the present invention can be easily construed by programmers skilled in the art to which the present invention pertains.

In order to evaluate the performance of the pitch detection method according to an aspect of the present invention as described above, experiments were carried out under conditions of a 20 kHz sampling rate of voice samples, and 16-bit resolution of analog-to-digital conversion, and the characteristics of voices spoken by 5 male speakers and 5 female speakers are as shown in tables 1 and 2:

TABLE 1

| Male speakers | Entire length (sec) | Voiced sound interval (sec) | Average pitch (Hz) | Minimum pitch (Hz) | Maximum pitch (Hz) |
|---|---|---|---|---|---|
| M1 | 37.4 | 18.4 | 100 | 57 | 180 |
| M2 | 31.9 | 14.0 | 134 | 53 | 232 |
| M3 | 27.2 | 14.6 | 135 | 58 | 183 |
| M4 | 33.7 | 16.3 | 94 | 57 | 259 |
| M5 | 40.3 | 20.7 | 107 | 59 | 182 |

TABLE 2

| Female speakers | Entire length (sec) | Voiced sound interval (sec) | Average pitch (Hz) | Minimum pitch (Hz) | Maximum pitch (Hz) |
|---|---|---|---|---|---|
| M1 | 32.2 | 15.1 | 195 | 63 | 263 |
| M2 | 33.7 | 19.0 | 228 | 68 | 333 |
| M3 | 30.5 | 15.6 | 192 | 78 | 286 |
| M4 | 31.6 | 17.8 | 233 | 56 | 400 |
| M5 | 38.7 | 18.6 | 229 | 78 | 351 |

When the cut off frequency of the used low pass filter is 460 Hz, the results of detecting pitch periods by applying the pitch detection method according to an aspect of the present invention, prior art 1 (SegCor) using segment correlation, and prior art 2 (E_SegCor) using improved segment correlation, respectively, to the voice samples shown in tables 1 and 2, are shown in expression of voiced error rate (VER) and global error rate (GER) in table 3. Here, SegCor denotes the method disclosed by the article by Y. Medan, E. Yair, and D. Chazan, and E_SegCor denotes the method disclosed by the article by P. C. Bagshaw, S. M. Hiller and M. A. Jack described above.

TABLE 3

| | Prior art 1 (SegCor) | | Prior art 2 (E_SegCor) | | Present invention | |
|---|---|---|---|---|---|---|
| | VER | GER | VER | GER | VER | GER |
| Male speaker | 10.91 | 3.97 | 11.18 | 3.15 | 3.22 | 1.97 |
| Female speaker | 3.79 | 8.77 | 4.16 | 3.21 | 0.75 | 2.12 |
| Average | 7.32 | 6.49 | 7.64 | 3.18 | 1.97 | 2.05 |

Referring to table 3, when the pitch detection method of the present invention is applied, VER decreased by 73% and 74% and GER decreased by 68% and 36% compared to prior arts 1 and 2, respectively.

Next, when the cut off frequency of the used low pass filter is 230 Hz, the results of detecting a pitch by applying the pitch detection method according to the present invention, prior art 1 (SegCor) using segment correlation, and prior art 2 (E_SegCor) using improved segment correlation, respectively, to the voice samples shown in tables 1 and 2, are shown in expression of voiced error rate (VER) and global error rate (GER) in table 4:

TABLE 4

| | Prior art 1 (SegCor) | | Prior art 2 (E_SegCor) | | Present invention | |
|---|---|---|---|---|---|---|
| | VER | GER | VER | GER | VER | GER |
| Male speaker | 5.46 | 4.84 | 7.20 | 3.22 | 3.22 | 1.97 |
| Female speaker | 2.65 | 10.8 | 2.78 | 0.75 | 0.75 | 2.12 |
| Average | 4.04 | 7.90 | 4.97 | 2.35 | 1.97 | 2.05 |

Referring to table 4, when the pitch detection method of the present invention is applied, VER decreased by 51% and 60% and GER decreased by 74% and 13% compared to prior arts 1 and 2, respectively.

According to an aspect of the present invention as described above, by using even symmetrical components, pitch detection is performed such that the number of samples analysed in a single frame is reduced and the accuracy of pitch detection is greatly raised. Accordingly, voiced error rate (VER) and global error rate (GER) can be greatly reduced. In addition, by performing segment correlation of a reference point and a local pitch, the number of segments used in segment correlation is reduced compared to the prior art such that complexity of the calculation can be decreased and the time taken for performing the correlation can be reduced.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A pitch detection method comprising:

decomposing voice data rearranged on a basis of a central peak in a single frame into even-number symmetrical components;

detecting candidate pitches from the even-number symmetrical components; and determining a location of a candidate pitch corresponding to a maximum segment correlation value among segment correlation values between a reference point and each of the detected candidate pitches in relation to the even-number symmetrical components, as a pitch period, wherein the method is performed by at least one computer system.

2. The pitch detection method of claim 1, wherein the decomposing of the voice data comprises:

multiplying the voice data of the single frame by a first weight window function and then detecting a center peak of the voice data included in the single frame where an absolute value of a result of the multiplication is a maximum;

shifting the voice data of the single frame on the basis of the center peak; and decomposing the voice data of the single frame into even symmetrical components on the basis of the center peak.

3. The pitch detection method of claim 2, further comprising before the decomposing of the voice data:

performing low pass filtering of the voice data being input.

4. The pitch detection method of claim 1, wherein the decomposing of the voice data comprises:

multiplying the voice data of the single frame by a first weight window function and then detecting a center peak of the voice data included in the single frame where an absolute value of a result of the multiplication is a maximum;

shifting the voice data of the single frame on the basis of the center peak; and multiplying the voice data of the single frame by a second weight window function and then decomposing the voice data of the single frame multiplied by the second weight window function, into even symmetrical components on the basis of the center peak.

5. The pitch detection method of claim 4, further comprising before the decomposing of the voice data:

performing low pass filtering of the voice data being input.

6. The pitch detection method of claim 1, wherein the determining of the pitch period comprises:

selecting the maximum segment correlation value among obtained segment correlation values;

comparing the maximum segment correlation value with a predetermined threshold; and if the maximum segment correlation value is greater than the predetermined threshold, determining the location of the candidate pitch corresponding to the maximum segment correlation value, as the pitch period.

7. The pitch detection method of claim 1, wherein the candidate pitch is detected in any one of a negative number area and a positive number area according to a value of a center peak of the voice data included in the single frame.

8. The pitch detection method of claim 1, wherein the candidate pitch corresponds to a local peak with a value greater than a predetermined value.

9. A computer readable recording medium having embodied thereon a computer program for a pitch detection method comprising:

decomposing voice data rearranged on a basis of a central peak in a single frame into even-number symmetrical components;

detecting candidate pitches from the even-number symmetrical components; and determining a location of a candidate pitch corresponding to a maximum segment correlation value among segment correlation values between a reference point and each of the detected candidate pitches in relation to the even-number symmetrical components, as a pitch period.

10. The computer readable recording medium of claim 9, wherein the candidate pitch corresponds to a local peak with a value greater than a predetermined value.

11. A pitch detection apparatus comprising:

a decomposition unit which decomposes voice data rearranged on a basis of a central peak in a single frame into even-number symmetrical components; and a pitch determination unit which detects candidate pitches from the even-number symmetrical components, and determines a location of a candidate pitch corresponding to a maximum segment correlation value among segment correlation values between a reference point and each of the detected candidate pitches in relation to the even-number symmetrical components, as a pitch period.

12. The pitch detection apparatus of claim 11, further comprising a data rearrangement unit which rearranges the voice data on the basis of a center peak of the voice data included in the single frame and provides the rearranged voice data to the decomposition unit.

13. The pitch detection apparatus of claim 12, wherein the data rearrangement unit comprises:

a center peak determination unit which multiplies the voice data of the single frame by a first weight window function and then determines a center peak of the voice data included in the single frame where an absolute value of the multiplication is a maximum; and a data transition unit which shifts the voice data of the single frame on the basis of the center peak.

14. The pitch detection apparatus of claim 11, wherein the decomposition unit multiplies the voice data of the single frame by a second weight window function and then decomposes the voice data of the single frame multiplied by the second weight window function, into the even symmetrical components on the basis of a center peak of the voice data included in the single frame.

15. The pitch detection apparatus of claim 11, wherein the pitch determination unit comprises:

a local peak detection unit which detects candidate pitches in relation to the even symmetrical components;

a correlation value calculation unit which obtains a segment correlation value between the reference point and each of the candidate pitches; and a pitch period determination unit which selects the maximum segment correlation value among the obtained segment correlation values, and if the maximum segment correlation value is greater than a predetermined threshold, determines the location of the candidate pitch corresponding to the maximum segment correlation value, as the pitch period.

16. The pitch detection apparatus of claim 11, wherein the candidate pitch is detected in any one of a negative number area and a positive number area according to a value of a center peak of the voice data included in the single frame.

17. The pitch detection apparatus of claim 11, wherein the candidate pitch corresponds to a local peak with a value greater than a predetermined value.

18. A pitch detection apparatus comprising:

a data rearrangement unit shifting voice data based on a determined center peak included in a single frame unit;

a decomposition unit decomposing the shifted voice data into even-number symmetrical components; and a pitch determination unit determining a location of a local peak corresponding to a maximum segment correlation value among segment correlation values between a reference point and at least one or more local peaks in relation to the even-number symmetrical components, as a pitch period.

19. The pitch detection apparatus of claim 18, wherein the data rearrangement unit comprises:

a filter unit filtering the voice data;

a frame forming unit dividing the voice data in predetermined time units and forming frame units;

a center peak determination unit multiplying the voice data by a predetermined weight window and determining a location where an absolute value of the multiplication is a maximum as a center peak; and a data transition unit shifting the voice data based on the determined center peak so that the center peak is placed at a center of the voice data.

20. The pitch detection apparatus of claim 18, wherein the pitch determination unit comprises:

a local peak detection unit detecting local peaks from the even-number symmetrical components;

a correlation value calculation unit obtaining segment correlation values between a reference point and each of the local peaks detected by the local peak detection unit; and a pitch period determination unit selecting a maximum segment correlation value among the segment correlation values, and if the maximum segment correlation value is greater than a predetermined threshold, determining the location of the local peak used to obtain the maximum segment correlation value, as a pitch period.

21. The pitch detection apparatus of claim 18, wherein the local peak is detected in any one of a negative number area or a positive number area according to the center peak.

22. A pitch detection method comprising:

shifting voice data based on a determined center peak included in a single frame unit;

decomposing the shifted voice data into even-number symmetrical components; and determining a location of a local peak corresponding to a maximum segment correlation value among segment correlation values between a reference point and at least one or more local peaks in relation to the even-number symmetrical components, as a pitch period, wherein the method is performed by at least one computer system.

23. The pitch detection method of claim 22, wherein the shifting of the voice data further comprises:

filtering the voice data;

dividing the voice data in predetermined time units and forming frame units;

multiplying the voice data by a predetermined weight window and determining a location where an absolute value of the multiplication is a maximum, as a center peak; and shifting the voice data based on the determined center peak so that the center peak is placed at a center of the voice data.

24. The pitch detection method of claim 22, wherein the determining of the location of the local peak corresponding to the maximum segment correlation value comprises:

detecting local peaks from the even-number symmetrical components;

obtaining segment correlation values between a reference point and each of the detected local peaks; and selecting a maximum segment correlation value among the segment correlation values, and if the maximum segment correlation value is greater than a predetermined threshold, determining the location of the local peak used to obtain the maximum segment correlation value, as a pitch period.

* * * * *

UNITED STATES PATENT AND TRADEMARK OFFICE

CERTIFICATE OF CORRECTION

PATENT NO. : 7,593,847 B2
APPLICATION NO. : 10/968942
DATED : September 22, 2009
INVENTOR(S) : Kwangcheol Oh It is certified that error appears in the above-identified patent and that said Letters Patent is hereby corrected as shown below:

Column 10, Line 55, change "maximum" to --maximum,--.

Signed and Sealed this

Twenty-ninth Day of December, 2009

David J. Kappos

David J. Kappos
*Director of the United States Patent and Trademark Office*